US011462132B2

(12) United States Patent
Bellamah

(10) Patent No.: US 11,462,132 B2
(45) Date of Patent: Oct. 4, 2022

(54) LABEL FOR PACK

(71) Applicant: Altria Client Services LLC, Richmond, VA (US)

(72) Inventor: Stephen Bellamah, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 122 days.

(21) Appl. No.: 16/239,522

(22) Filed: Jan. 3, 2019

(65) Prior Publication Data

US 2020/0219418 A1 Jul. 9, 2020

(51) Int. Cl.

| | |
|---|---|
| ***B65D 51/00*** | (2006.01) |
| ***G09F 3/10*** | (2006.01) |
| ***B65D 85/10*** | (2006.01) |
| ***B65D 55/00*** | (2006.01) |
| *G09F 3/02* | (2006.01) |

(52) U.S. Cl.

CPC ..... *G09F 3/10* (2013.01); *B65D 51/00* (2013.01); *B65D 55/00* (2013.01); *B65D 85/1054* (2013.01); *B65D 85/10568* (2020.05); *G09F 2003/0222* (2013.01); *G09F 2003/0239* (2013.01); *G09F 2003/0241* (2013.01); *G09F 2003/0264* (2013.01); *G09F 2003/0272* (2013.01)

(58) Field of Classification Search

CPC ..... B65D 85/10; B65D 85/10564; B65D 85/10568; B65D 85/1045; B65D 85/1054; B65D 85/1056; B65D 51/00; B65D 55/00; B65D 55/02; B65D 17/4014; B65D 5/28; G09F 3/10; G09F 2003/0241; G09F 2003/0272; G09F 2003/0239; G09F 2003/0264

See application file for complete search history.

(56) References Cited

U.S. PATENT DOCUMENTS

| | | | |
|---|---|---|---|
| 2,191,704 | A | 3/1935 | Bennett |
| 3,535,409 | A | 10/1970 | Rohde |
| 3,606,138 | A | 9/1971 | Allison |

(Continued)

FOREIGN PATENT DOCUMENTS

| | | | |
|---|---|---|---|
| CN | 208070426 | U | 11/2018 |
| EP | 2985239 | A1 | 2/2016 |

(Continued)

OTHER PUBLICATIONS

International Search Report and Written Opinion dated Feb. 14, 2018 in corresponding International Patent Application No. PCT/US2017/056272, 15 pages.

(Continued)

*Primary Examiner* — Scott R. Walshon
*Assistant Examiner* — Thomas A Mangohig
(74) *Attorney, Agent, or Firm* — Harness, Dickey & Pierce, P.L.C.

(57) ABSTRACT

A reseal label for at least partially covering a pack for consumer goods includes a sheet of polymer material having a pull tab and one or more panels configured to at least partially cover the pack for consumable goods. The reseal label includes resealable adhesive on the pull tab, and permanent adhesive on one or more of the one or more panels to adhere to one or more walls of the pack.

22 Claims, 6 Drawing Sheets

(56) References Cited

U.S. PATENT DOCUMENTS

| | | | | |
|---|---|---|---|---|
| 3,625,270 | A | 12/1971 | Skendzic | |
| 3,695,422 | A | 10/1972 | Tripodi | |
| 3,804,235 | A | 4/1974 | Anderson | |
| 3,996,945 | A | 12/1976 | McDowell | |
| 4,105,116 | A | 8/1978 | Jones et al. | |
| 4,300,676 | A | 11/1981 | Focke et al. | |
| 4,483,018 | A | 11/1984 | Whelan | |
| 4,509,196 | A | 4/1985 | Sak et al. | |
| 4,586,312 | A | 5/1986 | Limousin | |
| 4,709,399 | A | 11/1987 | Sanders | |
| 4,941,196 | A | 7/1990 | Edelman et al. | |
| 5,022,950 | A | 6/1991 | Ingalls et al. | |
| 5,035,935 | A | 7/1991 | Thomas et al. | |
| 5,172,980 | A | 12/1992 | Provost | |
| 5,352,041 | A | 10/1994 | Fullerton et al. | |
| 5,606,846 | A | 3/1997 | Raby et al. | |
| 5,613,779 | A | 3/1997 | Niwa | |
| 5,631,068 | A | 5/1997 | Smith | |
| 5,772,330 | A | 6/1998 | Bang et al. | |
| 5,775,812 | A | 7/1998 | St. Phillips et al. | |
| 5,954,431 | A | 9/1999 | Fabel | |
| 5,996,784 | A | 12/1999 | Thoeren et al. | |
| 6,000,539 | A | 12/1999 | Stewart-Cox et al. | |
| 6,036,006 | A | 3/2000 | Focke | |
| 6,164,444 | A | 12/2000 | Bray et al. | |
| 6,237,760 | B1 | 5/2001 | Parker et al. | |
| 6,286,999 | B1 | 9/2001 | Cappel et al. | |
| 6,342,258 | B1 | 1/2002 | Berings et al. | |
| 6,439,770 | B2 | 8/2002 | Catchman | |
| 6,447,015 | B1 | 9/2002 | Linnewiel | |
| 6,467,614 | B1 | 10/2002 | Tallier et al. | |
| 6,478,149 | B1 | 11/2002 | Parker | |
| 6,505,735 | B1 * | 1/2003 | Parker | B65D 85/1045 206/268 |
| 6,575,625 | B2 | 1/2003 | Cappel et al. | |
| 6,606,840 | B2 | 8/2003 | Focke et al. | |
| 6,663,283 | B1 | 12/2003 | Cappel | |
| 6,692,149 | B2 | 2/2004 | Baker et al. | |
| 6,817,764 | B2 | 11/2004 | O'Rourke et al. | |
| 6,820,395 | B2 | 11/2004 | Ausnit | |
| 6,874,623 | B2 | 4/2005 | Bray | |
| 6,974,406 | B2 | 12/2005 | Antonacci | |
| 7,008,106 | B2 | 3/2006 | Cappel | |
| 7,533,773 | B2 | 5/2009 | Aldridge et al. | |
| 7,566,488 | B2 | 7/2009 | Mimura et al. | |
| 7,588,143 | B2 | 9/2009 | Focke et al. | |
| 7,604,008 | B2 | 10/2009 | Gomez | |
| 7,971,711 | B2 | 7/2011 | Squarzoni et al. | |
| 8,091,703 | B2 | 1/2012 | Marchetti et al. | |
| 8,114,451 | B2 * | 2/2012 | Sierra-Gomez | B65D 75/5838 383/203 |
| 8,118,161 | B2 * | 2/2012 | Guerrera | B65D 77/003 206/274 |
| 8,123,030 | B2 | 2/2012 | Hein | |
| 8,266,868 | B2 | 9/2012 | Bellamah | |
| 8,276,750 | B2 | 10/2012 | Biondi et al. | |
| 8,474,612 | B2 | 7/2013 | Bertuzzi et al. | |
| 8,556,072 | B2 | 10/2013 | Bertuzzi et al. | |
| 8,590,701 | B2 | 11/2013 | Bertuzzi et al. | |
| 8,671,648 | B2 | 3/2014 | Bertuzzi et al. | |
| 9,089,165 | B2 | 7/2015 | Bertuzzi et al. | |
| 9,359,124 | B2 | 6/2016 | Lutzig | |
| 9,382,062 | B2 | 7/2016 | Mitten et al. | |
| 10,077,132 | B2 * | 9/2018 | Bellamah | B65D 5/563 |
| 10,086,987 | B2 * | 10/2018 | Bellamah | B65D 77/042 |
| 10,124,953 | B2 * | 11/2018 | Bellamah | B65D 5/4266 |
| 10,450,120 | B1 * | 10/2019 | Bellamah | B65D 75/5838 |
| 10,526,121 | B2 * | 1/2020 | Bellamah | B65D 85/1045 |
| 2003/0133630 | A1 | 7/2003 | Wang | |
| 2005/0142315 | A1 | 6/2005 | DeSimone et al. | |
| 2005/0226542 | A1 | 10/2005 | Kendall et al. | |
| 2005/0284775 | A1 | 12/2005 | McLaughlin et al. | |
| 2006/0011504 | A1 | 1/2006 | Gosebruch et al. | |
| 2006/0021883 | A1 | 2/2006 | Focke et al. | |
| 2006/0054670 | A1 | 3/2006 | Focke et al. | |
| 2006/0133700 | A1 | 6/2006 | Cappel | |
| 2008/0128300 | A1 | 6/2008 | Bahar et al. | |
| 2008/0230410 | A1 | 9/2008 | Steven Jones et al. | |
| 2009/0308766 | A1 | 12/2009 | Polloni et al. | |
| 2010/0163563 | A1 | 7/2010 | Lutzig | |
| 2011/0114518 | A1 | 5/2011 | Hein | |
| 2011/0180432 | A1 | 7/2011 | Blick et al. | |
| 2012/0111746 | A1 | 5/2012 | Tanbo et al. | |
| 2012/0177307 | A1 | 7/2012 | Duan et al. | |
| 2012/0291401 | A1 | 11/2012 | Mitten et al. | |
| 2014/0079343 | A1 * | 3/2014 | Lyzenga | B65B 9/073 383/203 |
| 2014/0374290 | A1 | 12/2014 | Seyfferth De Oliveira | |
| 2015/0021219 | A1 | 1/2015 | Seyfferth De Oliveira | |
| 2015/0034509 | A1 | 2/2015 | Seyfferth De Oliveira | |
| 2015/0041346 | A1 | 2/2015 | Seyfferth De Oliveira | |
| 2015/0320111 | A1 | 11/2015 | Slooff | |
| 2015/0375923 | A1 | 12/2015 | Pilzecker | |
| 2016/0236855 | A1 | 8/2016 | Chatelain et al. | |
| 2016/0368645 | A1 | 12/2016 | Buse | |
| 2017/0036849 | A1 | 2/2017 | Mitten et al. | |

FOREIGN PATENT DOCUMENTS

| | | | |
|---|---|---|---|
| EP | 3009374 | A1 | 4/2016 |
| GB | 2493905 | A | 2/2013 |
| WO | WO 2008142540 | A1 | 11/2008 |
| WO | WO 2013120916 | A1 | 8/2013 |
| WO | 2013131620 | A1 | 9/2013 |
| WO | WO 2014195008 | A2 | 12/2014 |
| WO | WO 2016059077 | A1 | 4/2016 |
| WO | WO 2016087819 | A1 | 6/2016 |
| WO | WO 2016102461 | A1 | 6/2016 |
| WO | WO 2017002002 | A1 | 1/2017 |
| WO | WO 2018024375 | A1 | 2/2018 |
| WO | WO 2018059729 | A1 | 4/2018 |
| WO | 2018154508 | A1 | 8/2018 |

OTHER PUBLICATIONS

Extended European Search Report dated Apr. 12, 2018 in corresponding European Patent Application No. 17196271.5-1016 (9 pages).

International Search Report and Written Opinion dated Apr. 23, 2018 in corresponding International Patent Application No. PCT/US2018/020127, (13 pages).

International Search Report and Written Opinion of the International Searching Authority issued Sep. 1, 2017 in corresponding International Patent Application No. PCT/US17/46406 (13 pages).

Extended European Search Report dated Jul. 28, 2020 in corresponding European Patent Application No. EP 20150067.5-1016, 11 pages.

Office Action for corresponding European patent application No. 20 150 067.5 dated Feb. 15, 2022, five pages.

* cited by examiner

LABEL FOR PACK

FIELD

The present disclosure relates to a package for consumer goods and particularly to a resealable pack for tobacco heat sticks, cigarettes, or any other consumer goods.

BACKGROUND

Various approaches have been made for packaging consumer goods. Known packages employ outer containers having a hinged lid that provides access to the consumer goods, or to an inner container, structure or space where the consumer goods are located.

SUMMARY

Some example embodiments described herein are directed to a reseal label for at least partially covering a pack for consumer goods. The reseal label includes a sheet of polymer material having a pull tab and one or more panels configured to at least partially cover the pack for consumable goods. The reseal label includes resealable adhesive on the pull tab, and permanent adhesive on one or more of the one or more panels to adhere to one or more walls of the pack. In an example embodiment, the one or more panels are configured to cover over 25% of the pack. In an example embodiment, the one or more panels are configured to cover over 50% of the pack. In an example embodiment, the one or more panels are configured to cover over 75% of the pack. In an example embodiment, the one or more panels are configured to cover over 95% of the pack. In an example embodiment, the sheet includes resealable adhesive on the one or more panels, a deadener on the resealable adhesive on the one or more panels, and wherein the permanent adhesive on the one or more of the one or more panels is on the deadener. In an example embodiment, the sheet of polymer material has a width of about 90 mm to about 110 mm and a length of about 140 mm to about 150 mm. In an example embodiment, the pull tab is substantially triangular in shape. In an example embodiment, the pull tab is substantially trapezoidal in shape.

In an example embodiment, the pack is a hinged lid pack wherein the one or more panels are configured to at least partially cover a hinged lid of the pack. In this embodiment, the one or more walls of the pack can further include one or more exterior walls of a hinged lid of the pack.

In an example embodiment described herein, the one or more panels of the reseal label includes an upper front panel connected along a first transverse fold line to the pull tab. The one or more panels can further include a top panel connected along a second transverse fold line to the upper front panel. The one or more panels can further include an upper back panel connected along a third transverse fold line to the top panel. The one or more panels can further include a lower back panel connected along a fourth transverse fold line to the upper back panel. The one or more panels can further include a bottom panel connected along a fifth transverse fold line to the lower back panel. The one or more panels can further include a lower front panel connected along a sixth transverse fold line to the bottom panel. In an example embodiment, the pull tab is configured to resealably adhere to at least a portion of the lower front panel. In an example embodiment, the one or more panels further includes upper front panel side flaps connected to the upper front panel along longitudinal fold lines and top panel side flaps connected to the top panel along longitudinal fold lines. In an example embodiment, the upper front panel side flaps each have a first edge extending transversely outward from a lower end of the longitudinal fold line, a second edge extending upwardly from a distal end of the first edge, and a third edge extending upwardly and inwardly from an upper end of the second edge to an upper end of the longitudinal fold line. In an example embodiment, the upper front panel side flaps are substantially trapezoidal in shape. In an example embodiment, the top panel side flaps each have a first edge extending transversely outward from a lower end of the longitudinal fold line, a second edge extending upwardly and outwardly from a distal end of the first edge, a third edge extending upwardly from an upper end of the second edge, and a fourth edge extending inwardly from an upper end of the third edge to an upper end of the longitudinal fold line. In an example embodiment, the top panel side flaps are substantially pentagonal in shape. In an example embodiment, the one or more panels further includes upper back panel side flaps connected to the upper back panel along longitudinal fold lines. In an example embodiment, the upper back panel side flaps each have a first edge extending outwardly and downwardly from a lower end of the longitudinal fold line, a second edge extending upwardly from a distal end of the first edge, and a third edge extending inwardly from an upper end of the second edge to an upper end of the longitudinal fold line. In an example embodiment, the upper back panel side flaps are substantially trapezoidal in shape. In an example embodiment, the one or more panels further includes lower back panel side flaps connected to the lower back panel along longitudinal fold lines. In an example embodiment, the lower back panel side flaps each have a first edge extending transversely outward from a lower end of the longitudinal fold line, a second edge extending upwardly from a distal end of the first edge, and a third edge extending upwardly and inwardly from an upper end of the second edge to an upper end of the longitudinal fold line. In an example embodiment, the lower back panel side flaps are substantially trapezoidal in shape. In an example embodiment, the one or more panels further includes bottom panel side flaps connected to the bottom panel along longitudinal fold lines. In an example embodiment, the one or more panels further includes lower front panel side flaps connected to the lower front panel along longitudinal fold lines.

Some example embodiments described herein are directed to a reseal label for a hinged lid pack for consumer goods wherein the reseal label includes a sheet of polymer material having a front side and a back side. The sheet includes a pull tab and a first panel wherein the pull tab has resealable adhesive on the back side, and the first panel has permanent adhesive on the front side to adhere to an inner front surface of a hinged lid of the hinged lid pack.

In an example embodiment, the pull tab is substantially triangular in shape. In an example embodiment, the pull tab is substantially trapezoidal in shape. In an example embodiment, the sheet further includes one or more panels connected to the first panel along respective fold lines wherein one or more of the one or more panels have permanent adhesive thereon to adhere to one or more respective interior walls of the hinged lid pack. In an example embodiment, the pull tab is connected to the first panel along a first transverse fold line. In an example embodiment, the pull tab is configured to resealably adhere to at least a portion of an exterior front wall of the hinged lid pack. In an example embodiment, the polymer material includes polyethylene terephthalate (PET). In an example embodiment, the polymer material includes polyethylene. In an example embodiment, the reseal label includes a resealable adhesive on the back side of the first panel, and a deadener on the resealable adhesive on the back side of the first panel. In an example embodiment, the reseal label includes permanent adhesive on the front side of the pull tab, and a deadener on the permanent adhesive on the front side of the pull tab. In an example embodiment, Some example embodiments described herein are directed to a method of wrapping a hinged lid pack in a reseal label. The method includes adhering a lower front panel of the reseal label to a front wall of the pack with permanent adhesive, folding the reseal label such that a bottom panel is adhered to a bottom wall of the pack with permanent adhesive, folding the reseal label such that a lower back panel is adhered to a back wall of the pack with the permanent adhesive and an upper back panel is adhered to a back wall of a hinged lid of the pack with permanent adhesive, folding the reseal label such that a top panel is adhered to a top wall of the hinged lid of the pack with permanent adhesive, folding the reseal label such that an upper front panel is adhered to a front wall of the hinged lid of the pack with permanent adhesive, and adhering a pull tab of the reseal label to the lower front panel with the resealable adhesive.

In an example embodiment, the reseal label includes lower front panel side flaps, bottom panel side flaps, lower back panel side flaps, upper back panel side flaps, top panel side flaps, and upper front panel side flaps, the method further comprising folding the reseal label such that the bottom panel side flaps are adhered to side walls of the pack with permanent adhesive. In an example embodiment, the method includes folding the reseal label such that the top panel side flaps are adhered to side walls of the hinged lid of the pack with permanent adhesive. In an example embodiment, the method includes folding the reseal label such that the lower back panel side flaps are adhered to the side walls of the pack with permanent adhesive. In an example embodiment, the method includes folding the reseal label such that the upper back panel side flaps are adhered to the side walls of the hinged lid of the pack with permanent adhesive. In an example embodiment, the method includes folding the reseal label such that the lower front panel side flaps are adhered to the side walls of the pack with permanent adhesive. In an example embodiment, the method includes folding the reseal label such that the upper front panel side flaps are adhered to the side walls of the hinged lid of the pack with permanent adhesive. In an example embodiment, the lower back panel side flaps are adhered to the bottom panel side flaps. In an example embodiment, the upper back panel side flaps are adhered to the top panel side flaps. In an example embodiment, the lower front panel side flaps are adhered to the lower back panel side flaps. In an example embodiment, the upper front panel side flaps are adhered to the upper back panel side flaps.

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one example embodiment and/or example method can be used on or in conjunction with other example embodiments and/or method steps to yield yet further example embodiments or methods. It is intended that the present disclosure includes such modifications and variations. In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value. In this specification, the word "or" is used inclusively.

Example embodiments disclosed herein are directed to a reseal label with adhesives for application to a pack to convert the pack into a resealable pack. The reseal label can be applied to a hinged lid pack such that a resealable portion of the reseal label can be peeled off of a surface of the hinged lid pack to open the hinged lid. After opening, the hinged lid can be closed and the hinged lid pack can be resealed by pressing the resealable portion against the surface from which it was peeled. The reseal label can provide a hinged lid pack with a resealable closure, and in some embodiments, additional graphical applications.

In some example embodiments, a reseal label can be sized to cover an outer surface of a hinged lid pack, either all outer surfaces of the hinged lid pack, or one or more outer surfaces of the hinged lid pack, or portions thereof. In an example embodiment, a reseal label can be a flexible film of polymer material with cut lines that align with portions of the pack such as edges where the hinged lid opens. In some examples, the reseal label can include connections between the cuts which may assist in application of the reseal label to the pack, but which can break when the reseal label is folded around the pack. In some examples, the label can include a barrier type film such as a metallized film, coated film or other type of high WVTR (water vapor transmission rate) material.

Figure 1A:
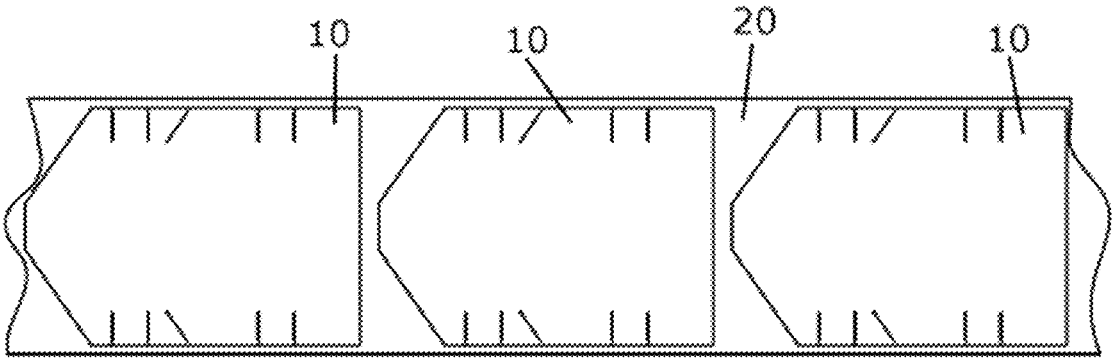
FIG. 1A illustrates a succession of reseal labels carried on a backing tape, according to an example embodiment.
Figure 1B:
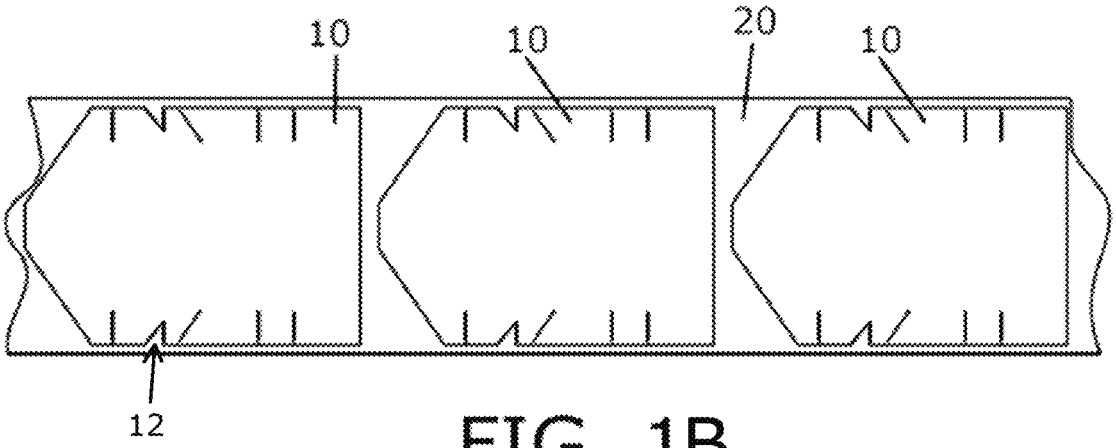
FIG. 1B illustrates a succession of reseal labels carried on a backing tape, according to an example embodiment.
Figure 1C:
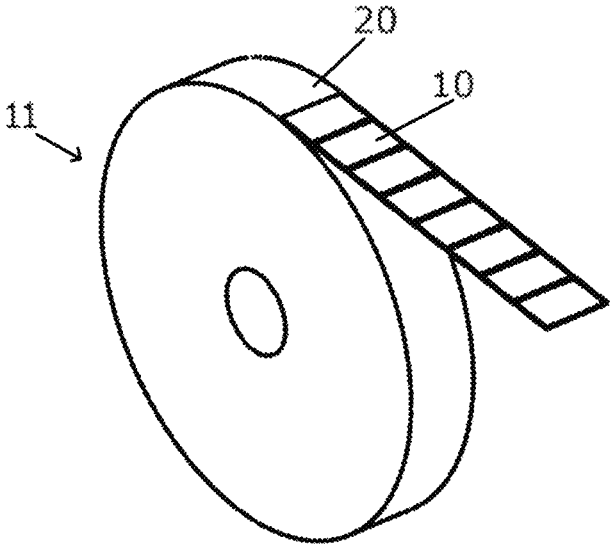
FIG. 1C illustrates a roll of backing tape that carries a succession of reseal labels, according to an example embodiment.

FIGS. 1A and 1B each illustrate a succession of reseal labels 10 carried on a backing tape 20 according to an example embodiment. In a high speed packaging operation, each label 10 is peeled off of the backing tape 20 and adhered to and/or wrapped around a pack, such as a hinged lid pack, or portions of a hinged lid pack, such that a resealable portion of the label can be peeled from an outer surface of the wrapped pack and used to open a hinged lid of the pack. In an example embodiment, as illustrated in FIG. 1B, the reseal labels 10 include indents 12. In an example embodiment, the reseal labels 10 do not include the indents 12 (see FIG. 1A). FIG. 3A illustrates an example embodiment of a roll 12 of backing tape 20 that carries the reseal labels 10. In an example embodiment, the roll 12 is configured to provide a succession of the reseal labels 10 to a packaging machine in a high speed packaging operation.

Figure 2:
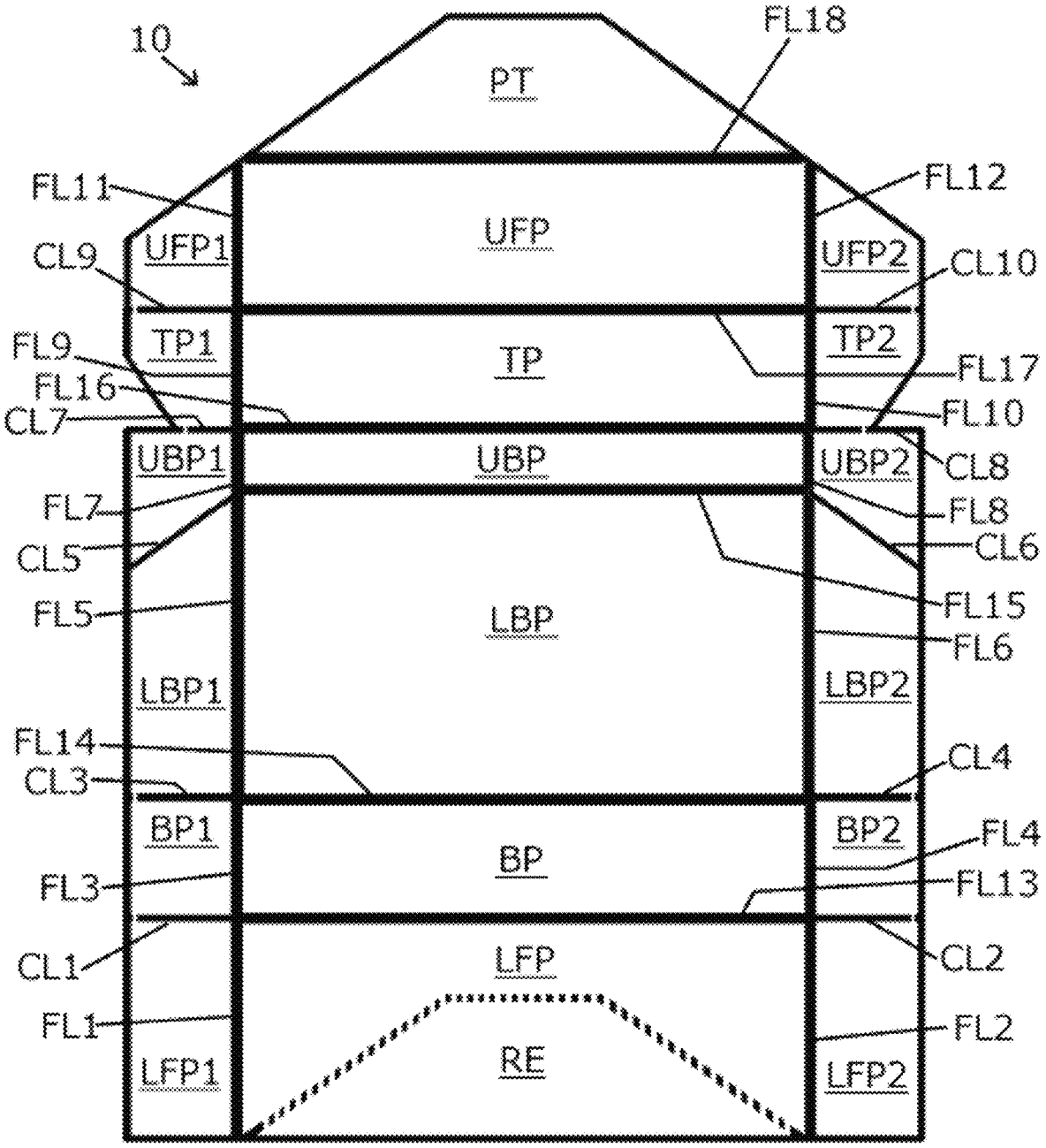
FIG. 2 illustrates a reseal label prior to application of adhesive, according to an example embodiment.

FIG. 2 illustrates a reseal label 10 prior to application of adhesive, according to an example embodiment. In this example, the reseal label 10 is shown in an unfolded condition with longitudinal and transverse fold lines labeled FL and cut lines labeled CL. The label 10 includes panels with side flaps configured to cover respective panels of the pack. In an example embodiment, the label 10 can have a width corresponding approximately to the width across the front wall and depth of the side walls of the hinged lid box. For example, to cover a hinged lid box, also referred to herein as pack (P), having a height of about 48 mm, a width of about 74 mm and a depth of about 14 to 16 mm, the reseal label 10 can have a length of about 145 mm and a width of about 103 mm. Other dimensions may be used, and reseal labels in some example embodiments may not cover or attach to every wall of the hinged lid box. In other words, other example embodiments of a reseal label may only attach to one or more walls of a hinged lid box, or portions thereof.

In the example embodiment shown in FIG. 2, the reseal label 10 can include a lower front panel (LFP) connected to lower front panel side flaps (LFP1, LFP2) along longitudinal fold lines (FL1, FL2), a bottom panel (BP) connected to bottom panel side flaps (BP1, BP2) along longitudinal fold lines (FL3, FL4), a lower back panel (LBP) connected to lower back panel side flaps (LBP1, LBP2) along longitudinal fold lines (FL5, FL6), an upper back panel (UBP) connected to upper back panel side flaps (UBP1, UBP2) along longitudinal fold lines (FL7, FL8), a top panel (TP) connected to top panel side flaps (TP1, TP2) along longitudinal fold lines (FL9, FL10), an upper front panel (UFP) connected to upper front panel side flaps (UFP1, UFP2) along longitudinal fold lines (FL11, FL12), and a pull tab (PT).

Further describing the example embodiment of FIG. 2, the lower front panel (LFP) is connected to the bottom panel (BP) along transverse fold line (FL13), the lower back panel (LBP) is connected to the bottom panel (BP) along transverse fold line (FL14), the upper back panel (UBP) is connected to the lower back panel (LBP) along transverse fold line (FL15), the top panel (TP) is connected to the upper back panel (UBP) along transverse fold line (FL16), the upper front panel (UFP) is connected to the top panel (TP) along transverse fold line (FL17), and the pull tab (PT) is connected to the upper front panel (UFP) along transverse fold line (FL18).

When applied to a hinged lid box/pack (P), label 10 of the example embodiment of FIG. 2 can be applied as follows, according to an example embodiment: the lower front panel (LFP) is adhered to a lower front wall of the pack, the bottom panel (BP) is adhered to a bottom wall of the pack, the lower back panel (LBP) and the upper back panel (UBP) are adhered to a back wall of the pack (the back wall of the pack includes the back wall of the hinged lid of the pack in an example embodiment), the top panel (TP) is adhered to a top wall of the pack (which is also the top wall of the hinged lid of the pack in an example embodiment), the upper front panel (UFP) is adhered to an upper front wall of the pack (which is also the front wall of the hinged lid of the pack in an example embodiment), the resealable pull tab (PT) is adhered to a reseal area (RE) of the lower front panel (LFP), the bottom panel side flaps (BP1, BP2) are adhered to lower portions of respective side walls of the pack, the top panel side flaps (TP1, TP2) are adhered to upper portions of respective side walls of the pack (said upper portions are also the side walls of the hinged lid of the pack in an example embodiment), the lower back panel side flaps (LBP1, LBP2) are adhered to outer surfaces of the respective bottom panel side flaps (BP1, BP2) and exposed portions of the side walls of the pack, the upper back panel side flaps (UBP1, UBP2) are adhered to outer surfaces of the respective top panel side flaps (TP1, TP2) and exposed upper portions of the side walls of the pack, and the upper front panel side flaps (UFP1, UFP2) are adhered to outer surfaces of the respective upper back panel side flaps (UBP1, UBP2). The resealable pull tab (PT) is adhered to the reseal area (RE) of the lower front panel (LFP) with resealable adhesive such that the resealable pull tab (PT) can be peeled off the lower front panel (LFP) and used to lift the hinged lid to open the pack. The hinged lid can be closed and the pack can be resealed by readhering the resealable pull tab (PT) to the reseal area (RE) of the lower front panel (LFP).

Figure 3:
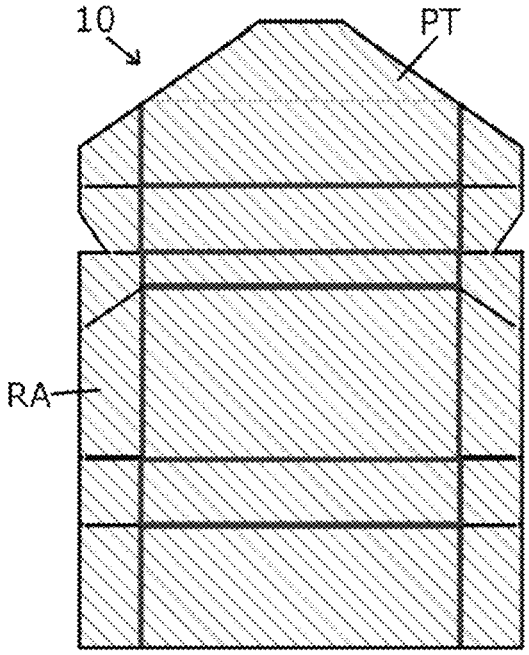
FIG. 3 illustrates the reseal label of FIG. 2 with resealable adhesive applied on a surface thereof, according to an example embodiment.

FIG. 3 illustrates the reseal label 10 of FIG. 2 with resealable adhesive (RA) applied on a surface thereof, according to an example embodiment. In the example shown in FIG. 3, the resealable adhesive (RA) can be flood coated on a surface of the label 10 so as to coat the entire surface. In an example embodiment, the resealable adhesive (RA) can be applied by a printing operation.

Figure 4:
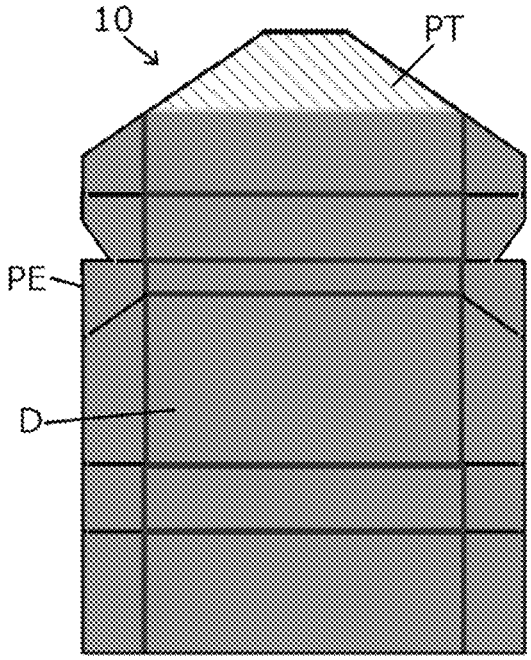
FIG. 4 illustrates the reseal label of FIG. 3 with deadener applied over a portion of the resealable adhesive, according to an example embodiment.

FIG. 4 illustrates the reseal label of FIG. 3 with deadener (D) applied over a portion of the resealable adhesive (RA), according to an example embodiment. In the example shown in FIG. 3, in order to provide a resealable pull tab (PT), the deadener (D) is applied over the entire surface of the reseal label 10 except the resealable pull tab (PT) at the free end of the upper front panel (UFP). In an example embodiment, the deadener (D) is applied such that it covers the entire surface of the resealable adhesive (RA) outside of the resealable pull tab (PT). In an example embodiment, the deadener (D) is applied such that it leaves a border area of exposed resealable adhesive (RA) along perimeter edges (PE) of the reseal label 10 (some example embodiments do not leave such a border area of exposed resealable adhesive). In an example embodiment, the border area of exposed resealable adhesive (RA) can separate the deadener from the perimeter edges (PE) by about 0.5 mm, but other dimensions may be used. In an example embodiment, the deadener (D) is applied by a printing operation.

Figure 5:
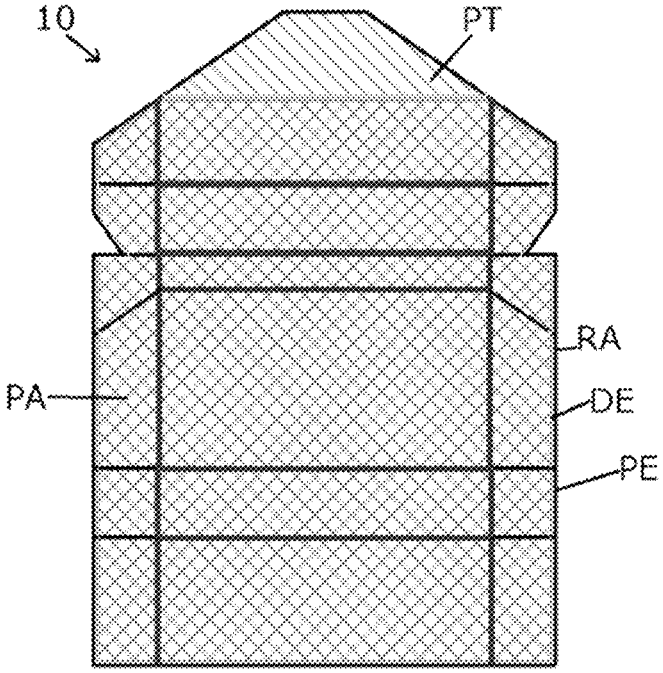
FIG. 5 illustrates the reseal label of FIG. 4 with permanent adhesive applied over the deadener, according to an example embodiment.

FIG. 5 illustrates the reseal label of FIG. 4 with permanent adhesive (PA) applied over the deadener (D), according to an example embodiment. In this example, the permanent adhesive (PA) is not applied over the area covered with resealable adhesive (RA) on the resealable pull tab (PT). In an example embodiment, the permanent adhesive (PA) is applied such that it covers the entire surface of the deadener (D). In an example embodiment, the permanent adhesive (PA) can be applied such that it covers the deadener (D) with the permanent adhesive (PA) except along an outer border area thereof such that the deadener (D) remains exposed along deadened edges (DE) of the reseal label 10 that are uncovered with permanent adhesive (PA) inward of a border area of exposed resealable adhesive (RA). In one example embodiment, the outer border area of deadened edges (DE) can separate the permanent adhesive (PA) from exposed resealable adhesive (RA) along the perimeter edges (PE) by about 0.5 mm. In some example embodiments, there is no border of exposed resealable adhesive, or border of exposed deadener. Some examples may include a border of exposed deadener but no border of exposed resealable. In an example embodiment, the permanent adhesive (PA) is applied by a printing operation.

Figure 6:
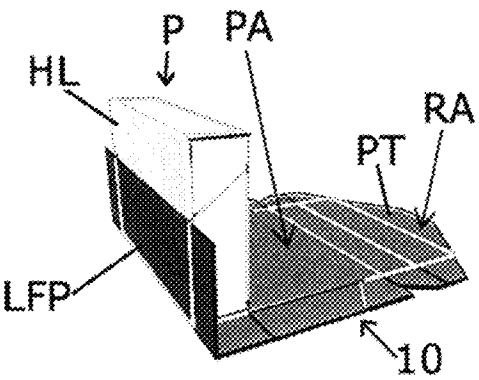
FIG. 6 illustrates a reseal label being wrapped around a hinged lid pack with the reseal label applied to a lower portion of the front wall and bottom wall of the pack, according to an example embodiment.

FIG. 6 illustrates a reseal label 10 being wrapped around a pack (P) such as a pack having a hinged lid (HL) wherein the reseal label 10 is applied to a lower portion of the front wall and bottom wall of the pack, according to an example embodiment. As shown in the example embodiment, the inside surface of the resealable pull tap (PT) is coated with resealable adhesive (RA) and other inside surfaces of the reseal label 10 are coated with permanent adhesive (PA), such as one to all of the remaining inside surfaces. The reseal label 10 is applied to the pack (P) such that the lower front panel (LFP) is adhered with permanent adhesive (PA) to a lower front wall of the pack (P), and the bottom panel (BP) is adhered with permanent adhesive (PA) to the bottom wall of the pack (P). In an example embodiment, one or more surfaces (i.e., panels) of the reseal label 10, such as the lower front panel (LFP), lower front panel side flaps (LFP1, LFP2), bottom panel (BP), bottom panel side flaps (BP1, BP2), lower back panel (LBP), lower back panel side flaps (LBP1, LBP2), upper back panel (UBP), upper back panel side flaps (UBP1, UBP2), top panel (TP), top panel side flaps (TP1, TP2), upper front panel (UFP), upper front panel side flaps (UFP1, UFP2) do not require permanent adhesive (PA) for the reseal label 10 to be wrapped around and adhered to pack (P), and are therefore free of permanent adhesive (PA). In this example, those surfaces which do not include the permanent adhesive (PA) can include resealable adhesive (RA) or deadener (D). For example, an embodiment as disclosed herein can include permanent adhesive on the lower front panel (LFP) of the reseal label 10 while the bottom panel (BP) is free of permanent adhesive (PA). In a further example embodiment, the reseal label 10 can include permanent adhesive (PA) on the lower front panel (LFP), which adheres the reseal label 10 to the lower front wall of the pack 10, and permanent adhesive (PA) on the upper front panel (UFP), which adheres the reseal label 10 to the upper front wall of the pack (P), while one or more panels of the reseal label 10, such as the panels between the lower front panel (LFP) and upper front panel (UFP) are free of permanent adhesive (PA). Other variations may be used where permanent adhesive is only used where it may be necessary to hold the reseal label 10 in place on a pack (P).

Figure 7:
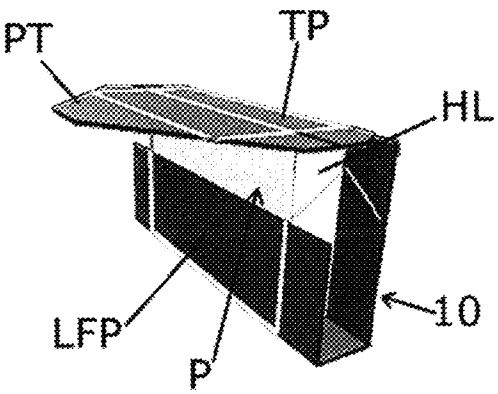
FIG. 7 illustrates the reseal label of FIG. 6 with the reseal label applied to the back wall and top wall of the pack, according to an example embodiment.

FIG. 7 illustrates the reseal label of FIG. 6 with the reseal label 10 partially wrapped around the pack (P) such that the reseal label 10 is also applied to the back wall and top wall of the pack (P), according to an example embodiment. As shown in the example embodiment, the reseal label 10 can be applied to the pack (P) such that the lower back panel (LBP) and upper back panel (UBP) are adhered with permanent adhesive (PA) to the back wall of the pack (P) and the top panel (TP) is adhered with permanent adhesive to the top wall of the pack (P).

Figure 8:
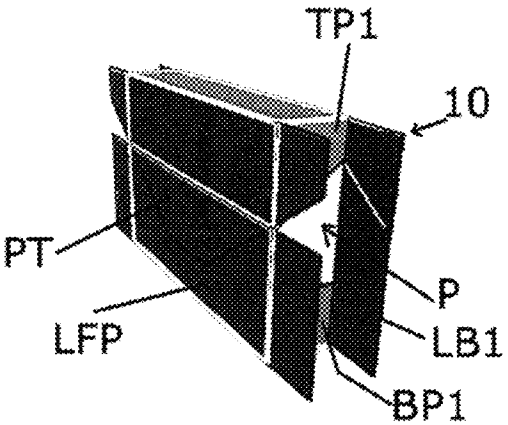
FIG. 8 illustrates the reseal label of FIG. 7 with the reseal label applied to the front wall of the pack and part of the side walls, according to an example embodiment.

FIG. 8 illustrates the reseal label of FIG. 7 with the reseal label 10 wrapped around the pack (P) such that it is also applied to an upper portion of the front wall of the pack (P) and the resealable pull tab (PT) is applied to an outer surface of the lower front panel (LFP) of the reseal label (10), according to an example embodiment. As shown in the example, the reseal label 10 can be applied to the pack (P) such that the upper front panel (UFP) is adhered with permanent adhesive to the upper front wall of the pack, the resealable pull tab (PT) is adhered with resealable adhesive to a portion of the lower front panel (LFP), the bottom panel side flaps (BP1, BP2) are adhered with permanent adhesive to lower portions of the side walls of the pack (P), and the top panel side flaps (TP1, TP2) are adhered with permanent adhesive to the side walls of the hinged lid of the pack (P).

Figure 9:
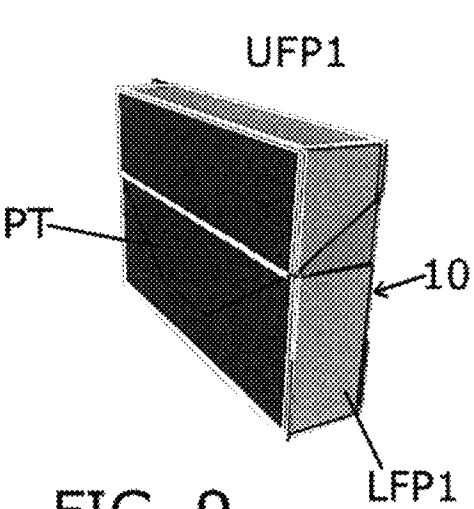
FIG. 9 illustrates the reseal label of FIG. 8 with the reseal label applied to the side walls of the pack, according to an example embodiment.

FIG. 9 illustrates the reseal label of FIG. 8 with the reseal label 10 applied to the side walls of the pack (P), according to an example embodiment. As shown in the example, the label 10 can be applied such that the lower back panel side flaps (LBP1, LBP2) are adhered with permanent adhesive to outer surfaces of bottom panel side flaps (BP1, BP2) and exposed portions of the side walls of the pack, the upper back panel side flaps (UBP1, UBP2) are adhered with permanent adhesive to outer surfaces of top panel side flaps (TP1, TP2) and exposed portions of the side walls of hinged lid, and the upper front panel side flaps (UFP1, UFP2) are adhered with permanent adhesive to outer surfaces of upper back panel side flaps (UBP1, UBP2). The pull tab (PT) is adhered with resealable adhesive to a portion of the lower front panel (LFP). The resealable pull tab (PT) can be peeled off the lower front panel (LFP) and used to pull open the hinged lid (HL) of the pack (P) when pulled in the direction of arrow (A).

Figure 10:
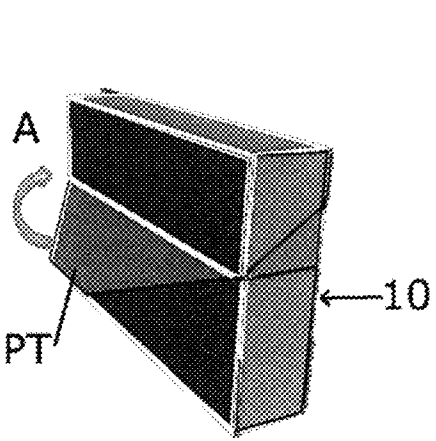
FIG. 10 illustrates the reseal label of FIG. 9 with the resealable pull tab in the front of the pack peeled from the lower front of the pack, according to an example embodiment.

FIG. 10 illustrates the reseal label of FIG. 9 with the resealable pull tab (PT) in the front of the pack (P) peeled from the lower front panel (LFP) of the label 10 in the direction A, according to an example embodiment.

Figure 11:
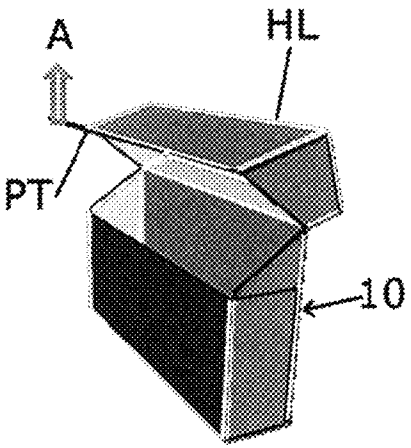
FIG. 11 illustrates the reseal label of FIG. 10 with the resealable pull tab lifted to open the hinged lid of the pack, according to an example embodiment.

FIG. 11 illustrates the reseal label of FIG. 10 with the resealable pull tab (PT) lifted in the direction (A) to open the hinged lid (HL) of the pack (P), according to an example embodiment. After opening the hinged lid (HL) to access contents of the pack (P), a consumer can reclose the hinged lid (HL) and press the resealable pull tab (PT) of the label 10 against the lower front panel (LFP) of the label 10 to provide better closure of the hinged lid (HL) of the pack (P). As explained above, the example embodiments of a reseal label 10 discussed above with reference to FIGS. 6-11 may have one or more surfaces (i.e., panels), such as the lower front panel (LFP), lower front panel side flaps (LFP1, LFP2), bottom panel (BP), bottom panel side flaps (BP1, BP2), lower back panel (LBP), lower back panel side flaps (LBP1, LBP2), upper back panel (UBP), upper back panel side flaps (UBP1, UBP2), top panel (TP), top panel side flaps (TP1, TP2), upper front panel (UFP), upper front panel side flaps (UFP1, UFP2) that are free of permanent adhesive (PA). In this example, those surfaces which do not include the permanent adhesive (PA) can include resealable adhesive (RA) or deadener (D). For example, an embodiment as disclosed herein can include permanent adhesive on the lower front panel (LFP) of the reseal label 10 while the bottom panel (BP) is free of permanent adhesive (PA). In a further example embodiment, the reseal label 10 can include permanent adhesive (PA) on the lower front panel (LFP), which adheres the reseal label 10 to the lower front wall of the pack 10, and permanent adhesive (PA) on the upper front panel (UFP), which adheres the reseal label 10 to the upper front wall of the pack (P), while one or more panels of the reseal label 10, such as the panels between the lower front panel (LFP) and upper front panel (UFP) are free of permanent adhesive (PA). Other variations may be used where permanent adhesive is only used where it may be necessary to hold the reseal label 10 in place on a pack (P).

The reseal label 10 can include one or more of the various layers discussed above. For example, the label can include a base film of polymer material. The polymer material can include polyethylene, polyethylene terephthalate (PET), and/or other suitable materials. In another example, the label can include an outer layer of ink to provide graphics and/or product indicia. In another example, the label can include a layer of resealable adhesive, a layer of deadener, and/or a layer of permanent adhesive applied to the base film. However, one or more of these layers may be omitted. For example, the layer of deadener can be omitted if the resealable adhesive and permanent adhesive are applied directly to the base film, such as, for example, applying the resealable adhesive and permanent adhesive in different locations (e.g., apply resealable adhesive in the pull tab portion, and permanent adhesive in a remaining portion of the label).

In an example embodiment (see for example FIG. 2), the reseal label 10 can include cut lines (CL) separating the respective side flaps. For example, the lower front panel side flaps (LFP1, LFP2) can be separated from the bottom panel side flaps (BP1, BP2) along cut lines (CL1, CL2), the bottom panel side flaps (BP1, BP2) can be separated from the lower back panel side flaps (LBP1, LBP2) along cut lines (CL3, CL4), the lower back panel side flaps (LBP1, LBP2) can be separated from upper back panel side flaps (UBP1, UBP2) along cut lines (CL5, CL6), the upper back panel side flaps (UBP1, UBP2) can be separated from the top panel side flaps (TP1, TP2) along cut lines (CL7, CL8), and the top panel side flaps (TP1, TP2) can be separated from the upper front panel side flaps (UFP1, UFP2) along cut lines (CL9, CL10). In some examples, one or more of the cut lines may include small connections within the cut lines that connect the flaps on each side of a cut. These small connections may assist in applying a label to a pack, and may be configured to break when the label is folded around the pack.

In an example embodiment, the cut lines (CL5, CL6) can be angled to match the angle of the lower edge of the side walls of the hinged lid of a pack. The angled cut lines (CL5, CL6) thus provide upper back panel side flaps (UBP1, UBP2) which are trapezoidal in shape to match the trapezoidal shape of the side walls of the hinged lid. If desired, the top panel side flaps (TP1, TP2) can include outer edges which include straight portions parallel to the fold lines (FL9, FL10) between the top panel (TP) and the top panel side flaps (TP1, TP2) and angled portions which extend from said straight portions to the cut lines (CL7, CL8) between the upper back panel side flaps (UBP1, UBP2) and the top panel side flaps (TP1, TP2). With such shapes, the top panel side flaps (TP1, TP2) can be folded over and adhered to the side walls of the hinged lid of an example embodiment without extending past the side walls of the hinged lid.

In an example embodiment, packs (P) filled with consumer items are fed along a production line and reseal labels 10 are wrapped around the packs (P) with resealable pull tabs (PT) adhered to the lower front walls of the packs (P).

Figure 12:
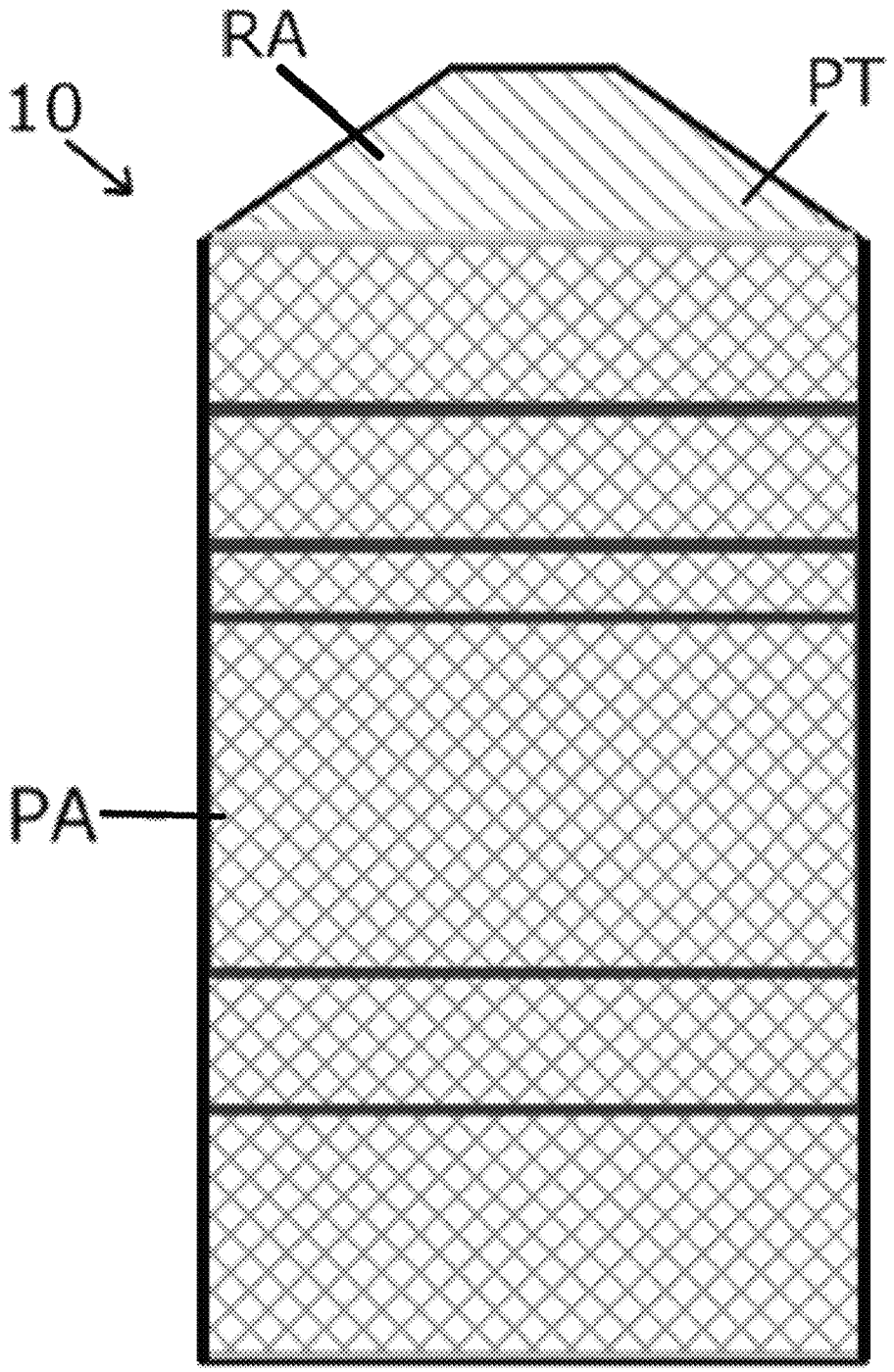
FIG. 12 illustrates a reseal label, according to an example embodiment.
Figure 15A:
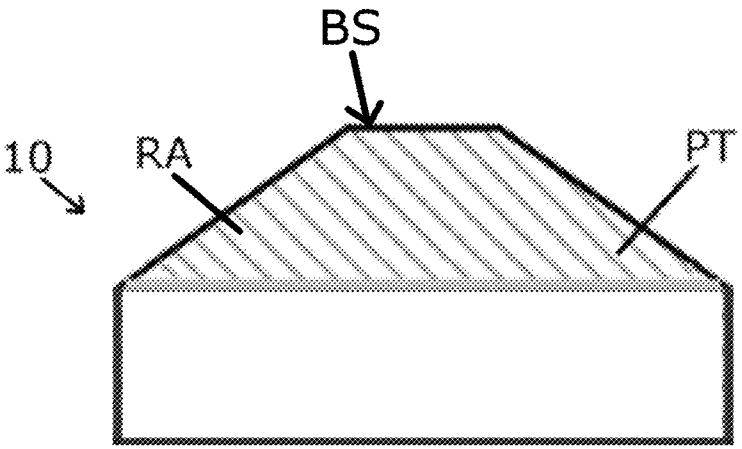
FIG. 15A illustrates a front side of a reseal label, according to an example embodiment.
Figure 15B:
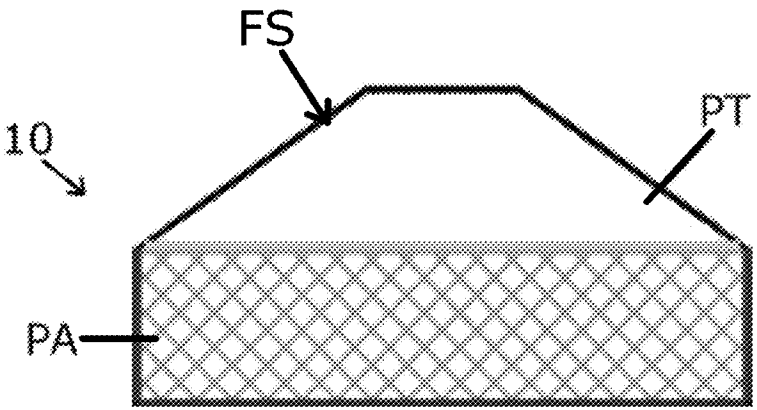
FIG. 15B illustrates a back side of the reseal label of FIG. 15A, according to an example embodiment.
Figure 13:
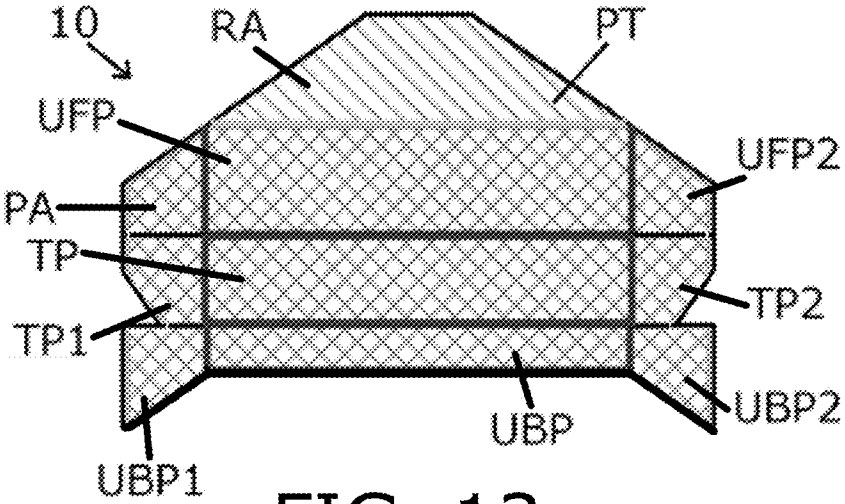
FIG. 13 illustrates a reseal label, according to an example embodiment.
Figure 14:
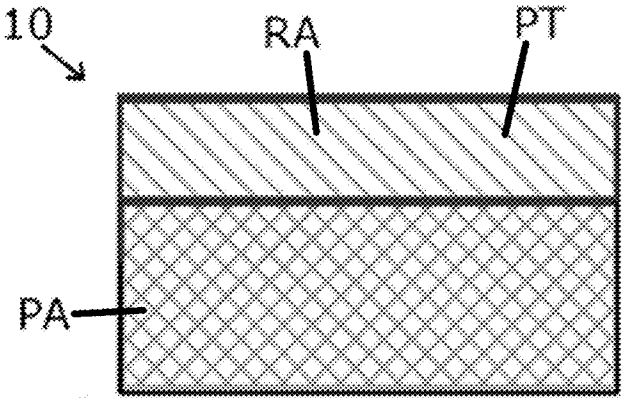
FIG. 14 illustrates a reseal label, according to an example embodiment.

Example embodiments of reseal labels 10 disclosed herein can have fewer panels than shown in FIG. 2, and/or one or more portions of the respective panels may be removed. FIGS. 12-15B illustrate example embodiments of reseal labels 10 having fewer panels than shown in FIG. 2. For example, an embodiment of a reseal label 10 as shown in FIG. 12 does not include the side flaps LFP1, LFP2, BP1, BP2, LBP1, LBP2, UBP1, UBP2, TP1, TP2, UFP1, UFP2. In an example embodiment shown in FIGS. 14, 15A, and 15B, the reseal label 10 can include only the pull tab (PT) having resealable adhesive (RA) and the upper front panel (UFP) having permanent adhesive (PA) such that the upper front panel (UFP) can be permanently adhered to the front wall of a hinged lid of a pack (P). In an example embodiment, shown in FIG. 13, the reseal label 10 can include only the panels UFP, UFP1, UFP2, TP, TP1, TP2, UBP, UBP1, UBP2 and the pull tab (PT) such that the reseal label 10 adheres to the just the hinged lid of the pack (P). In an example embodiment, the side flaps UFP1, UFP2, TP1, TP2, UBP1, and UBP2 can be omitted. FIGS. 15A and 15B illustrate a further example embodiment of a reseal label 10 wherein the reseal label has a back side (BS) and a front side (FS) wherein the pull tab (PT) at the back side (BS) includes resealable adhesive (RA) and the upper front panel (UFP) at the front side (FS) includes permanent adhesive (PA). In this example, the upper front panel (UFP) is permanently adhered to an inner front surface of the hinged lid of the pack (P) such that when the hinged lid is closed the pull tab (PT) can be resealably adhered to a lower front wall of the pack (P). In an example embodiment, packs (P) filled with consumer items are fed along a production line and reseal labels 10 are wrapped around the packs (P) with resealable pull tabs (PT) adhered to the lower front walls of the packs (P).

The presently disclosed embodiments are considered in all respects to be illustrative and not restricted. The scope of the invention is indicated by the appended claims rather than the foregoing description and all changes that come within the meaning and range and equivalence thereof are intended to be embraced therein.

What is claimed is:

1. A reseal label for partially covering a pack for consumer goods, the reseal label comprising:

a continuous sheet of polymer material including a pull tab, one or more panels configured to partially cover the pack for consumer goods, resealable adhesive on an entire surface of the pull tab, and permanent adhesive on at least one of the one or more panels such that the one or more panels adhere to one or more walls of the pack, the one or more panels including an upper front panel connected along a first transverse fold line to the pull tab, a top panel connected along a second transverse fold line to the upper front panel, an upper back panel connected along a third transverse fold line to the top panel, a lower back panel connected along a fourth transverse fold line to the upper back panel, a bottom panel connected along a fifth transverse fold line to the lower back panel, and a lower front panel connected along a sixth transverse fold line to the bottom panel, the pull tab being configured to resealably adhere to at least a portion of the lower front panel.

2. The reseal label of claim 1, wherein the sheet includes the permanent adhesive on each of the one or more panels.

3. The reseal label of claim 1, wherein the one or more panels are configured to at least partially cover a hinged lid of the pack.

4. The reseal label of claim 1, wherein the one or more panels are configured to cover over 25% of the pack.

5. The reseal label of claim 1, wherein the one or more panels further includes bottom panel side flaps connected to the bottom panel along longitudinal fold lines.

6. The reseal label of claim 1, wherein the one or more panels further includes lower front panel side flaps connected to the lower front panel along longitudinal fold lines.

7. The reseal label of claim 1, wherein the polymer material includes polyethylene terephthalate (PET).

8. The reseal label of claim 1, wherein the polymer material includes polyethylene.

9. The reseal label of claim 1, further including a resealable adhesive on the one or more panels, and a deadener on the resealable adhesive on the one or more panels, and wherein the permanent adhesive on the one or more of the one or more panels is on the deadener.

10. The reseal label of claim 1, wherein the pull tab is substantially triangular in shape.

11. The reseal label of claim 1, wherein the pull tab is substantially trapezoidal in shape.

12. The reseal label of claim 1, wherein the one or more panels further includes upper front panel side flaps connected to the upper front panel along longitudinal fold lines, and top panel side flaps connected to the top panel along longitudinal fold lines.

13. The reseal label of claim 12, wherein the upper front panel side flaps each have a first edge extending transversely outward from a lower end of the longitudinal fold line, a second edge extending upwardly from a distal end of the first edge, and a third edge extending upwardly and inwardly from an upper end of the second edge to an upper end of the longitudinal fold line.

14. The reseal label of claim 12, wherein the top panel side flaps each have a first edge, the first edge extending transversely outward from a lower end of the longitudinal fold line, a second edge, the second edge extending upwardly and outwardly from a distal end of the first edge, a third edge, the third edge extending upwardly from an upper end of the second edge, and a fourth edge, the fourth edge extending inwardly from an upper end of the third edge to an upper end of the longitudinal fold line.

15. The reseal label of claim 1, wherein the one or more walls of the pack includes one or more exterior walls of the pack.

16. The reseal label of claim 15, wherein the sheet includes the permanent adhesive on at least one of the one or more panels to adhere to each of the exterior walls of the pack.

17. The reseal label of claim 1, wherein the one or more panels further includes upper back panel side flaps connected to the upper back panel along longitudinal fold lines.

18. The reseal label of claim 17, wherein the upper back panel side flaps each have a first edge extending outwardly and downwardly from a lower end of the longitudinal fold line, a second edge extending upwardly from a distal end of the first edge, and a third edge extending inwardly from an upper end of the second edge to an upper end of the longitudinal fold line.

19. The reseal label of claim 1, wherein the one or more panels further includes lower back panel side flaps connected to the lower back panel along longitudinal fold lines.

20. The reseal label of claim 19, wherein the lower back panel side flaps each have a first edge extending transversely outward from a lower end of the longitudinal fold line, a second edge extending upwardly from a distal end of the first edge, and a third edge extending upwardly and inwardly from an upper end of the second edge to an upper end of the longitudinal fold line.

21. A reseal label for at least partially covering a pack for consumer goods, the reseal label comprising:

a continuous sheet of polymer material including a pull tab, one or more panels configured to at least partially cover the pack for consumer goods, resealable adhesive on an entire surface of the pull tab, and permanent adhesive on one or more of the one or more panels such that the one or more panels adhere to one or more walls of the pack, the one or more walls of the pack including one or more exterior walls of a hinged lid of the pack, the one or more panels including an upper front panel connected along a first transverse fold line to the pull tab, a top panel connected along a second transverse fold line to the upper front panel, an upper back panel connected along a third transverse fold line to the top panel, a lower back panel connected along a fourth transverse fold line to the upper back panel, a bottom panel connected along a fifth transverse fold line to the lower back panel, and a lower front panel connected along a sixth transverse fold line to the bottom panel, and the pull tab being configured to resealably adhere to at least a portion of the lower front panel.

22. The reseal label of claim 21, wherein the sheet includes the permanent adhesive on the top front panel, the top panel, the upper back panel, and side flap panels so as to adhere to all the exterior walls of the hinged lid of the pack.

* * * * *